US012091269B2

(12) United States Patent
Takamiya et al.

(10) Patent No.: US 12,091,269 B2
(45) Date of Patent: Sep. 17, 2024

(54) SHEET FEEDING APPARATUS AND IMAGE FORMING APPARATUS

(71) Applicants: Yohsuke Takamiya, Kanagawa (JP); Hidetoshi Kojima, Kanagawa (JP); Tatsuya Sugawara, Kanagawa (JP); Toshihiro Okutsu, Kanagawa (JP); Sachika Tamaki, Kanagawa (JP)

(72) Inventors: Yohsuke Takamiya, Kanagawa (JP); Hidetoshi Kojima, Kanagawa (JP); Tatsuya Sugawara, Kanagawa (JP); Toshihiro Okutsu, Kanagawa (JP); Sachika Tamaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 163 days.

(21) Appl. No.: 18/050,176

(22) Filed: Oct. 27, 2022

(65) Prior Publication Data

US 2023/0159289 A1 May 25, 2023

(30) Foreign Application Priority Data

Nov. 25, 2021 (JP) ..... 2021-191038

(51) Int. Cl.
*B65H 3/12* (2006.01)
*B65H 1/14* (2006.01)
(Continued)

(52) U.S. Cl.
CPC ..... *B65H 1/18* (2013.01); *B65H 1/20* (2013.01); *B65H 3/128* (2013.01); *B65H 3/48* (2013.01);
(Continued)

(58) Field of Classification Search
CPC ..... B65H 1/18; B65H 1/14; B65H 2511/13; B65H 2511/15; B65H 3/128; B65H 3/124; B65H 3/12; B65H 3/48
See application file for complete search history.

(56) References Cited

U.S. PATENT DOCUMENTS

2008/0191406 A1 8/2008 Fukatsu et al.
2011/0133390 A1 6/2011 Ohfuchi
(Continued)

FOREIGN PATENT DOCUMENTS

JP 2010-195588 9/2010
JP 2014-156310 8/2014
(Continued)

OTHER PUBLICATIONS

Extended European Search Report for 22207952.7 mailed on Apr. 28, 2023.

*Primary Examiner* — Luis A Gonzalez
(74) *Attorney, Agent, or Firm* — IPUSA, PLLC

(57) ABSTRACT

A sheet feeding apparatus includes a sheet stacker, an air blower, a suction feeder, a lifting mechanism, an elevation detection sensor, an elevation detection sensor, a feed detection sensor, and processing circuitry. The air blower blows air to float an uppermost sheet of sheets stacked on the sheet stacker. The processing circuitry drives the lifting mechanism such that the sheet stacker is lifted by an elevation amount determined based on a sheet thickness of the sheets stacked on the sheet stacker, each time a sheet is detected when a number of sheets detected is smaller than a threshold number of sheets, and stops lifting of the sheet stacker until a sheet is not detected when the number of sheets reaches the threshold number of sheets, while repeatedly feeding the uppermost sheet and counting the number of sheets.

10 Claims, 8 Drawing Sheets

(51) Int. Cl.

| | |
|---|---|
| ***B65H 1/18*** | (2006.01) |
| ***B65H 1/20*** | (2006.01) |
| ***B65H 3/48*** | (2006.01) |
| ***B65H 7/20*** | (2006.01) |

(52) U.S. Cl.
CPC ..... *B65H 7/20* (2013.01); *B65H 2511/20* (2013.01); *B65H 2511/30* (2013.01); *B65H 2801/06* (2013.01)

(56) References Cited

U.S. PATENT DOCUMENTS

| | | | | |
|---|---|---|---|---|
| 2018/0237239 | A1 | 8/2018 | Okutsu et al. | |
| 2019/0202647 | A1 | 7/2019 | Sugawara et al. | |
| 2021/0229941 | A1 | 7/2021 | Araki et al. | |
| 2021/0292118 | A1* | 9/2021 | Fukasawa ..... | B65H 3/128 |

FOREIGN PATENT DOCUMENTS

| | | |
|---|---|---|
| JP | 2019-119605 | 7/2019 |
| JP | 2021-035884 | 3/2021 |

* cited by examiner

SHEET FEEDING APPARATUS AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2021-191038, filed on Nov. 25, 2021, in the Japan Patent Office, the entire disclosure of which is hereby incorporated by reference herein.

BACKGROUND

Technical Field

Embodiments of the present disclosure relate to a sheet feeding apparatus and an image forming apparatus.

Related Art

A sheet feeding apparatus is known that includes a sheet stacker, an air blower, and a suction feeder. Multiple sheets are stacked on the sheet stacker. The air blower blows air to the multiple sheets stacked on the sheet stacker from a lateral side of the sheets to float an uppermost sheet of the sheets. The suction feeder is disposed above the sheet stacker and attracts the sheet floated by the air blower to feed the sheet in a feed direction.

In such a sheet feeding apparatus, when the number of sheets stacked on the sheet stacker decreases, air blown from the air blower passes above the sheets, and the sheets may not be properly floated. For this reason, a technology has been disclosed in which a sheet stacker is lifted by a constant elevation amount each time a sheet is fed when the number of sheets stacked on the sheet stacker is small.

SUMMARY

According to an embodiment of the present disclosure, a sheet feeding apparatus includes a sheet stacker, an air blower, a suction feeder, a lifting mechanism, an elevation detection sensor, a feed detection sensor, and processing circuitry. A plurality of sheets are stacked on the sheet stacker. The air blower blows air from a lateral side of the plurality of sheets stacked on the sheet stacker to the plurality of sheets to float an uppermost sheet of the plurality of sheets. The suction feeder is disposed above the sheet stacker and sucks the uppermost sheet floated by the air blower and feeds the sheet in a feed direction. The lifting mechanism lifts the sheet stacker. The elevation detection sensor detects that the plurality of sheets stacked on the sheet stacker has reached a detection position located above the sheet stacker and below the suction feeder. The feed detection sensor detects the sheet fed by the suction feeder. The processing circuitry controls operations of the air blower, the suction feeder, and the lifting mechanism based on detection results of the elevation detection sensor and the feed detection sensor. The processing circuitry drives the lifting mechanism such that the sheet stacker is lifted by an elevation amount determined based on a sheet thickness of the sheets stacked on the sheet stacker, each time a sheet is detected by the feed detection sensor when a number of sheets detected by the feed detection sensor is smaller than a threshold number of sheets and stops lifting of the sheet stacker until a sheet is not detected by the elevation detection sensor when the number of sheets reaches the threshold number of sheets, while repeatedly performing processing to feed the uppermost sheet floated by the air blower to the suction feeder and count the number of sheets detected by the feed detection sensor.

According to another embodiment of the present disclosure, an image forming apparatus includes the sheet feeding apparatus and an image forming device configured to form an image on a sheet fed by the sheet feeding apparatus.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
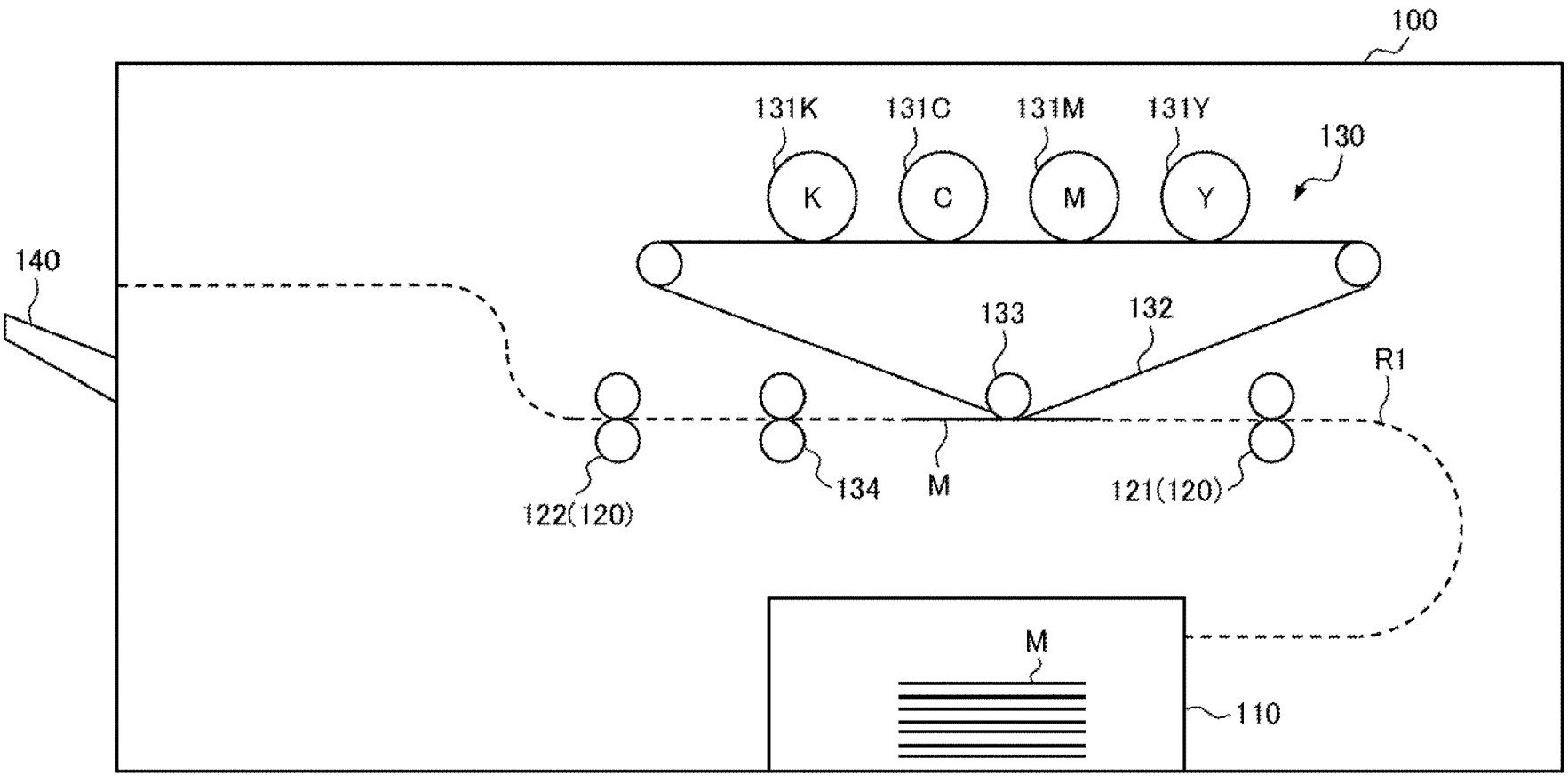
FIG. 1 is a schematic diagram illustrating an internal configuration of an image forming apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Embodiments of the present disclosure are described below with reference to the attached drawings. FIG. 1 is a schematic diagram illustrating an internal configuration of an image forming apparatus 100 according to an embodiment of the present disclosure. As illustrated in FIG. 1, the image forming apparatus 100 typically includes a feeder 110 as a sheet feeder, a conveyor 120, an image forming device 130, and an output tray 140. In the feeder 110, multiple sheets M as sheets of paper on which no images have been yet formed are stacked and stored. The sheet M on which an image has been formed is stored in the output tray 140.

The sheet M is an example of a sheet that is fed from the feeder 110, conveyed by the conveyor 120, and on which an image is formed by the image forming device 130. However, the sheet M is not limited to a sheet of paper, and may be, for example, an overhead projector (OHP) sheet, or cloth. A conveyance path R1 that is a space in which the sheet M is conveyed is formed inside the image forming apparatus 100. The conveyance path R1 is a path extending from the feeder 110 to the output tray 140 via a position facing the image forming device 130.

The feeder 110 stacks and stores multiple sheets M and feeds and supplies the stacked sheets M one by one to the conveyor 120. More specifically, the feeder 110 floats an uppermost sheet M of the stacked sheets M to feed the sheet M. A detailed configuration of the feeder 110 will be described below with reference to FIGS. 2 and 3.

The conveyor 120 conveys the sheet M fed from the feeder 110 in the conveyance path R1. Specifically, the conveyor 120 conveys the sheet M stored in the feeder 110 to the position facing the image forming device 130 in the conveyance path R1. The conveyor 120 ejects the sheet M on which an image has been formed by the image forming device 130 to the output tray 140 in the conveyance path R1.

The conveyor 120 includes multiple conveyance roller pairs 121 and 122. Each of the conveyance roller pairs 121 and 122 includes, for example, a driving roller to which a driving force of a motor is transmitted to rotate, and a driven roller that contacts the driving roller to be driven to rotate. The driving rollers and the driven rollers rotate while nipping the sheet M to convey the sheet M in the conveyance path R1.

The conveyance roller pair 121 is disposed upstream from the image forming device 130 in the conveyance direction. The conveyance roller pair 122 is disposed downstream from the image forming device 130 in the conveyance direction. However, positions at which the conveyance roller pair 121 and the conveyance roller pair 122 are disposed are not limited to the two positions illustrated in FIG. 1.

The image forming device 130 is disposed between the conveyance roller pair 121 and the conveyance roller pair 122 at a position facing the conveyance path R1. The image forming device 130 forms an image on a surface of a sheet M conveyed by the conveyor 120. The image forming device 130 according to the present embodiment forms an image on the sheet M conveyed in the conveyance path R1 by an electrophotographic method. However, the image forming method of the image forming device 130 may be an inkjet recording method in which ink is discharged onto a sheet M to form an image.

More specifically, in the image forming device 130, photoconductor drums 131Y, 131M, 131C, and 131K (referred to collectively as photoconductor drums 131 in the following description) for the respective colors are arranged along a transfer belt 132 that is an endless moving conveyor. In other words, the multiple photoconductor drums 131Y, 131M, 131C, and 131K are arranged along the transfer belt 132, on which an intermediate transfer image to be transferred to the sheet M fed from the feeder 110 is formed, in this order from upstream in a conveyance direction of the transfer belt 132.

Toner contained in toner bottles is supplied to the photoconductor drums 131. Images of the colors developed by the toner on the surfaces of the photoconductor drums 131Y, 131M, 131C, and 131K of the respective colors are superimposed and transferred onto the transfer belt 132. Thus, a full-color image is formed on the transfer belt 132. The full-color image formed on the transfer belt 132 is transferred to the sheet M by a transfer roller 133 at a position closest to the conveyance path R1.

Further, the image forming device 130 includes a fixing roller pair 134 disposed downstream from the transfer roller 133 in the conveyance direction. The fixing roller pair 134 includes a driving roller that is driven by a motor to rotate, and a driven roller that contacts the driving roller to be driven to rotate by the driving roller. Then, the driving roller and the driven roller rotate while the sheet M is nipped by the driving roller and the driven roller. At this time, the sheet M is heated and pressed and the image transferred by the transfer roller 133 is fixed onto the sheet M.

Figure 2:
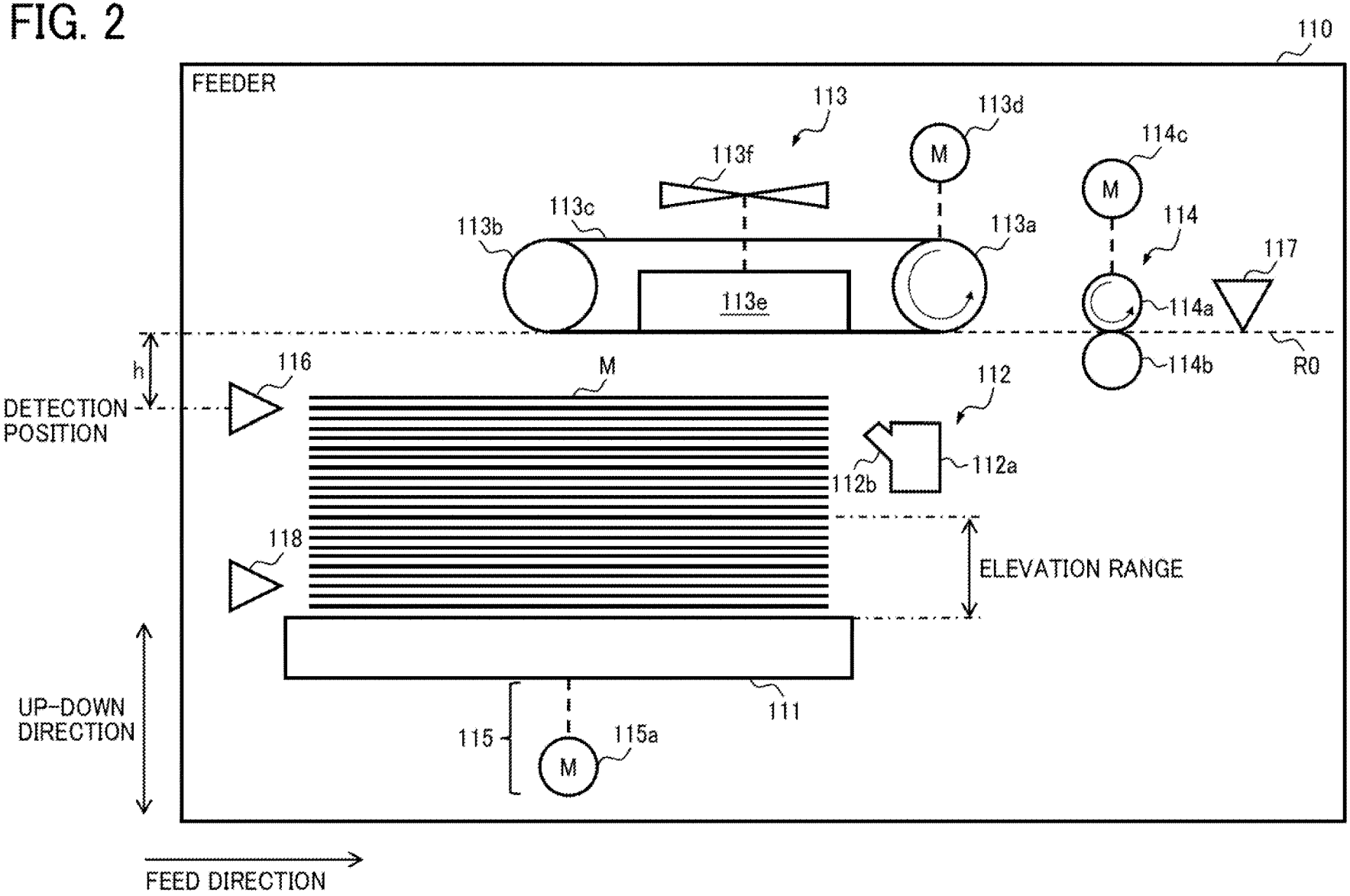
FIG. 2 is a schematic diagram illustrating a configuration of a feeder according to an embodiment of the present disclosure.

FIG. 2 is a schematic diagram illustrating the feeder 110 according to the present embodiment. FIGS. 3A, 3B, 3C, and 3D are diagrams illustrating how the feeder 110 operates, according to the present embodiment. The feeder 110 feeds sheets M one by one to the conveyance path R1 through a feed path R0. As illustrated in FIG. 2, the feeder 110 typically includes a sheet stacker 111 as a sheet stacker, an air blower 112, a suction feeder 113, a nip feeder 114, a lifting mechanism 115, an elevation detection sensor 116, a feed detection sensor 117, and a remaining amount detection sensor 118.

The sheet stacker 111 is an output tray or a sheet feed cassette on which multiple sheets M can be stacked. Sheets M can be replenished in the sheet stacker 111 by a user. Further, the sheet stacker 111 is supported by a frame of the feeder 110 so as to be moved up and down within a predetermined elevation range by the lifting mechanism 115.

Figure 3A:
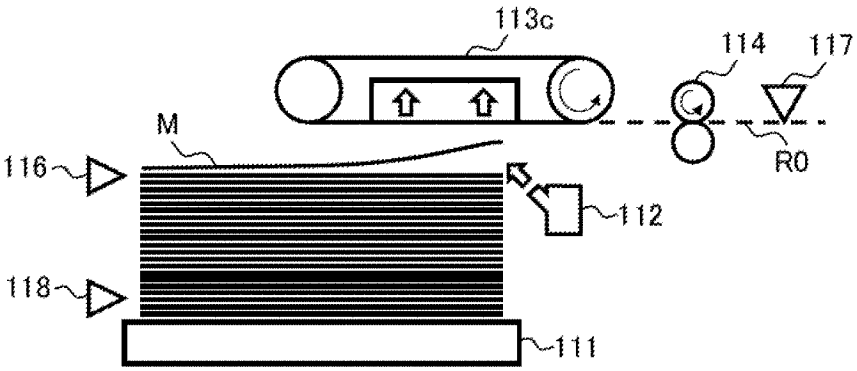
FIGS. 3A, 3B, 3C, and 3D are diagrams illustrating how the feeder of FIG. 2 operates.

The air blower 112 is disposed above the sheet stacker 111 and below the suction feeder 113. In addition, the air blower 112 is disposed at a position at which the air blower 112 can face the sheets M stacked on the sheet stacker 111 in the horizontal direction. As illustrated in FIG. 3A, the air blower 112 blows air from a lateral side of the sheets M to the multiple sheets M stacked on the sheet stacker 111 to float an uppermost sheet M.

The air blower 112 includes, for example, a float blower 112*a* and a blower port 112*b*. The float blower 112*a* generates air to float the uppermost sheet M. The blower port 112*b* blows the air generated by the float blower 112*a* obliquely upward toward the sheets M stacked on the sheet stacker 111. Then, the sheet stacker 111 is lifted or lowered by the lifting mechanism 115 so that the uppermost sheet M is positioned in a path in which the air is blown from the blower port 112*b* Thus, the uppermost sheet M is floated.

The suction feeder 113 is disposed above the sheet stacker 111, the air blower 112, and the elevation detection sensor 116. Further, the suction feeder 113 is disposed upstream from the nip feeder 114 and the feed detection sensor 117 in the feed direction. The suction feeder 113 attracts a sheet M floated by the air blower 112 and conveys the sheet M in the feed direction in the feed path R0. The feed path R0 is connected to the conveyance path R1.

The suction feeder 113 includes, for example, a driving pulley 113*a*, a driven pulley 113*b*, an endless annular belt 113*c*, a feeding motor 113*d*, a suction port 113*e*, and a suction fan 113*f* The driving pulley 113*a* and the driven pulley 113*b* are each rotatably supported at positions spaced apart in the feed direction. The endless annular belt 113*c* is wound around the driving pulley 113*a* and the driven pulley 113*b*. Multiple through-holes are formed on the surface of the endless annular belt 113*c*. The feeding motor 113*d* rotates the driving pulley 113*a*. The suction port 113*e* is disposed inside the endless annular belt 113*c* and is opened downward. The suction fan 113*f* sucks air from below the suction feeder 113 through the suction port 113*e* and the through-holes of the endless annular belt 113*c*.

Figure 3B:
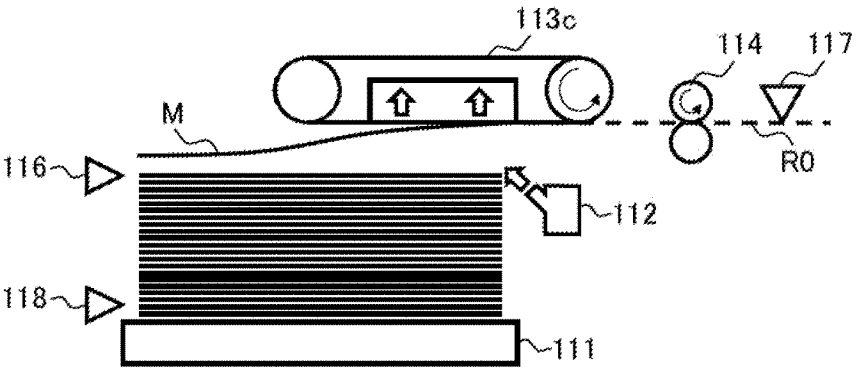
Figure 3C:
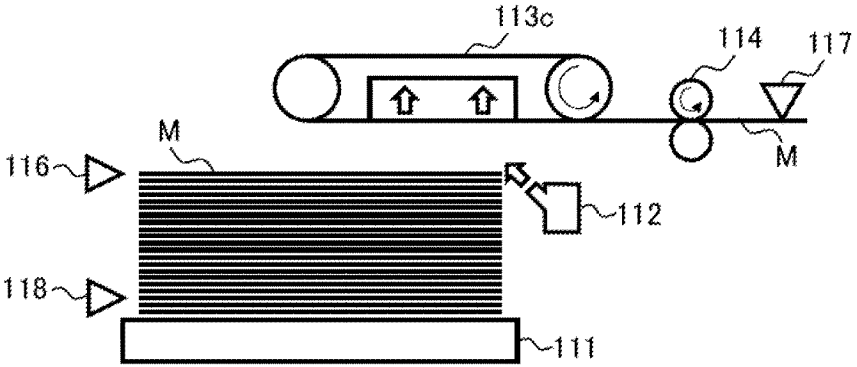

The suction fan 113*f* is driven to generate an upward air flow, as illustrated in FIG. 3B. Accordingly, a sheet M floated by the air blower 112 is attracted to a lower surface of the endless annular belt 113*c*. Further, the feeding motor 113*d* is driven to rotate the driving pulley 113*a*, in other words, the feeding motor 113*d* is driven to rotate the endless annular belt 113*c* counterclockwise, as illustrated in FIG. 3C. Accordingly, the sheet M attracted to the lower surface of the endless annular belt 113*c* is conveyed in the feed path R0 and supplied to the nip feeder 114.

The nip feeder 114 is disposed downstream from the suction feeder 113 in the feed direction and upstream from the feed detection sensor 117 in the feed direction. The nip feeder 114 feeds the sheet M supplied from the suction feeder 113 in the feed direction in the feed path R0. The nip feeder 114 includes, for example, a driving roller 114*a*, a driven roller 114*b*, and a feeding motor 114*c*.

The driving roller 114*a* and the driven roller 114*b* are rotatably supported by each other. The driving roller 114*a* and the driven roller 114*b* are in contact with each other with the feed path R0 interposed between the driving roller 114*a* and the driven roller 114*b*. The feeding motor 114*c* rotates the driving roller 114*a*. The driving roller 114*a* and the driven roller 114*b* of the nip feeder 114 nip and feed a sheet M that enters between the driving roller 114*a* and the driven roller 114*b*. Thus, the sheet M is fed to the conveyance path R1.

Figure 3D:
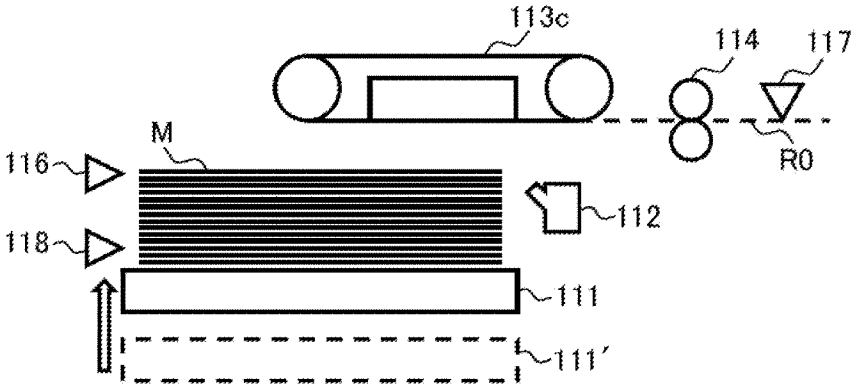

The lifting mechanism 115 lifts or lowers the sheet stacker 111. The lifting mechanism 115 includes, for example, a lifting motor 115*a* and a driving force transmitter that transmits the driving force of the lifting motor 115*a* to the sheet stacker 111. The driving force transmitter may include, for example, a pulley that is rotatably supported, and a belt that is wound around the pulley, with one end of the belt being connected to the sheet stacker 111 and the other end of the belt being connected to an output shaft of the lifting motor 115*a*. Then, as illustrated in FIG. 3D, the lifting mechanism 115 causes the lifting motor 115*a* to rotate in a first direction to lift the sheet stacker 111. Further, the lifting mechanism 115 rotates the lifting motor 115*a* in a second direction opposite to the first direction to lower the sheet stacker 111.

The elevation detection sensor 116 is fixed at a detection position located above the sheet stacker 111 and below the suction feeder 113. More specifically, the elevation detection sensor 116 is located at a position higher than the sheet stacker 111 in the horizontal direction when the sheet stacker 111 is located at an upper end of the elevation range of the sheet stacker 111. Further, the elevation detection sensor 116 is disposed at a position lower than the lower surface of the endless annular belt 113*c* in the horizontal direction by a height h (see FIG. 2). Further, the elevation detection sensor 116 is disposed at a position at which the elevation detection sensor 116 can face the sheets M stacked on the sheet stacker 111 in the horizontal direction. Accordingly, the elevation detection sensor 116 detects whether the uppermost sheet M of the sheets M stacked on the sheet stacker 111 reaches the detection position.

The elevation detection sensor 116 is, for example, a reflection-type optical sensor including a light emitter and a light receiver. The light emitter emits light in the horizontal direction from the detection position. The light receiver receives the light emitted from the light emitter and reflected by the sheets M stacked on the sheet stacker 111. When the light receiver receives the light, the elevation detection sensor 116 outputs an arrival signal indicating that the uppermost sheet M has reached the detection position to a controller 150, which will be described later. On the other hand, when the light receiver does not receive the light, the elevation detection sensor 116 stops outputting the arrival signal to the controller 150.

The feed detection sensor 117 is disposed downstream from the suction feeder 113 and the nip feeder 114 in the feed direction. Further, the feed detection sensor 117 is disposed to face the feed path R0. The feed detection sensor 117 detects whether a sheet M has passed through the feed path R0, in other words, whether the sheet M has been fed.

The feed detection sensor 117 is, for example, a reflection type optical sensor including a light emitter and a light receiver. The light emitter emits light toward the feed path R0. The light receiver receives the light emitted from the light emitter and reflected by the sheet M that passes through the feed path R0. When the light receiver receives the light, the feed detection sensor 117 outputs a feed signal indicating that the sheet M has been fed to the controller 150. On the other hand, when the light receiver does not receive the light, the feed detection sensor 117 stops outputting the feed signal to the controller 150.

The remaining amount detection sensor 118 is disposed at a position at which the remaining amount detection sensor 118 can face the sheets M stacked on the sheet stacker 111 in the horizontal direction. The remaining amount detection sensor 118 is movable up and down together with the sheet stacker 111 at a position slightly above the upper surface of the sheet stacker 111 in the horizontal direction. The remaining amount detection sensor 118 detects the remaining amount of the sheets M stacked on the sheet stacker 111. The remaining amount of the sheets M is indicated by, for example, a ratio when a maximum amount of the sheets M, e.g., a maximum number of the sheets M, that can be stacked on the sheet stacker 111 is set to 100%.

The remaining amount detection sensor 118 is, for example, a reflection-type optical sensor including a light emitter and a light receiver. The light emitter emits light in the horizontal direction. The light receiver receives the light emitted from the light emitter and reflected by the sheets M stacked on the sheet stacker 111. When the light receiver receives the light, the remaining amount detection sensor 118 outputs a remaining amount signal to the controller 150. The remaining amount signal indicates that the remaining amount of the sheets M stacked on the sheet stacker 111 is equal to or greater than a threshold remaining amount of X %. On the other hand, when the light receiver does not receive the light, the remaining amount detection sensor 118 stops outputting the remaining amount signal to the controller 150.

Figure 4:
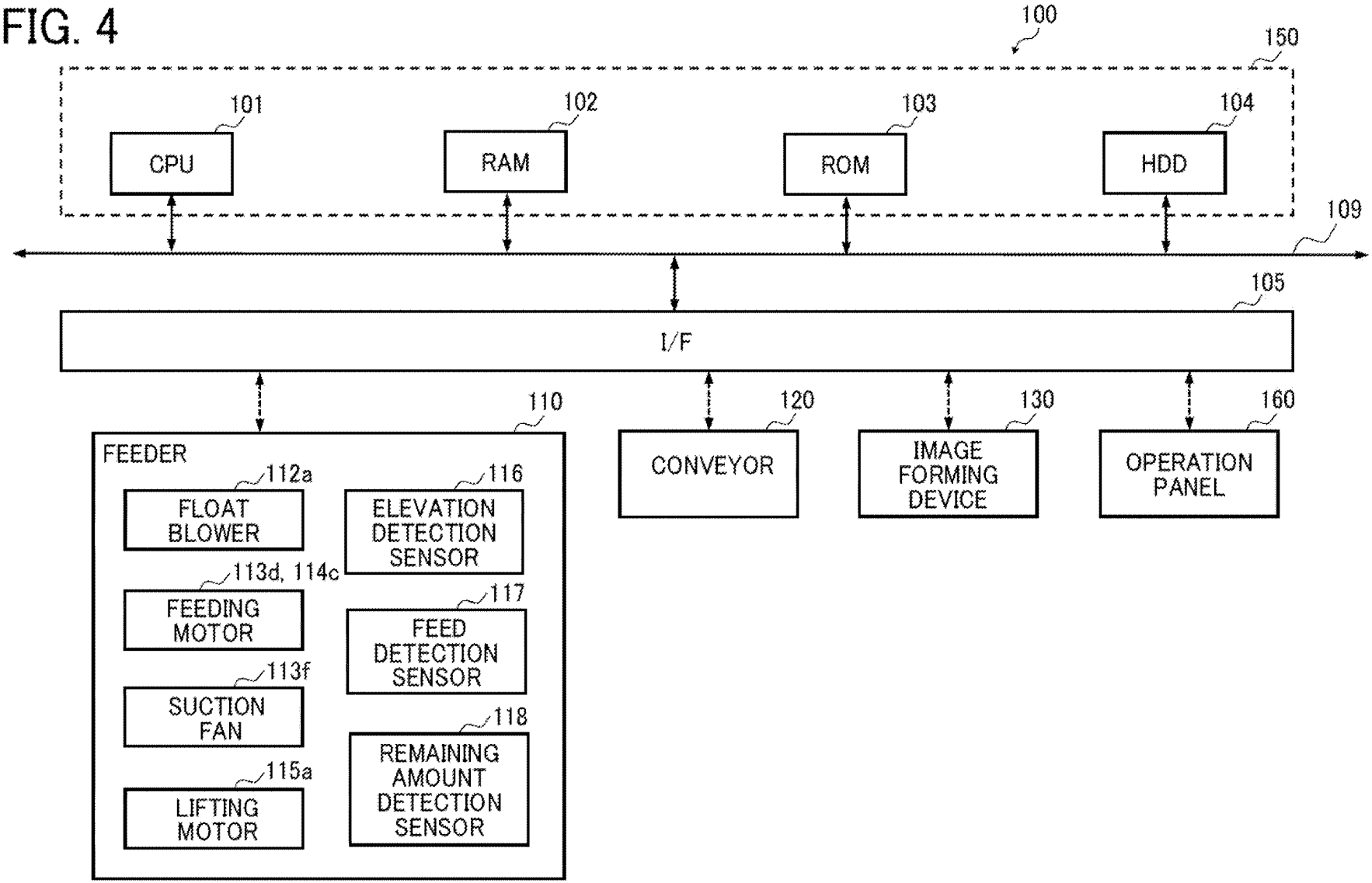
FIG. 4 is a block diagram illustrating a hardware configuration of the image forming apparatus of FIG. 1.

FIG. 4 is a block diagram illustrating a hardware configuration of the image forming apparatus 100 according to the present embodiment. The image forming apparatus 100 includes a central processing unit (CPU) 101 as a controller, a random access memory (RAM) 102 as a memory, a read only memory (ROM) 103 as a memory, a hard disk drive (HDD) 104 as a memory, and an interface (I/F) 105. The CPU 101, the RAM 102, the ROM 103, the HDD 104, and the I/F 105 are connected to each other via a common bus 109 as a communication member. The CPU 101, the RAM 102, the ROM 103, and the HDD 104 collectively serve as the controller 150.

The CPU 101 is an arithmetic unit and controls the entire operation of the image forming apparatus 100. The RAM 102 is a volatile recording medium capable of reading and writing data at high speed and is used as a work area when the CPU 101 processes the data. The ROM 103 is a read-only non-volatile recording medium in which programs such as firmware are stored. The HDD 104 is a large-capacity non-volatile recording medium capable of reading and writing data and stores, for example, an operating system (OS), various control programs, and application programs.

The image forming apparatus 100 processes programs such as a control program stored in the ROM 103, a data-processing program, which is an application program, loaded into the HDD 104 from a recording medium such as the RAM 102 by a calculation function included in the CPU 101. Such processing as described above is performed by a software controller that includes various functional modules of the image forming apparatus 100. A functional block that implements the functions of the image forming apparatus 100 includes a combination of the software controller as described above and the hardware resources installed in the image forming apparatus 100.

The I/F 105 is an interface that connects the feeder 110, the conveyor 120, the image forming device 130, and an operation panel 160 to the common bus 109. In other words, the controller 150 controls operations of the feeder 110, the conveyor 120, the image forming device 130, and the operation panel 160 via the I/F 105.

The operation panel 160 serves as a user interface that includes a display that displays, for example, current setting values, a selection screen and an operation panel that includes, for example, a touch panel and push buttons, that receives an input operation from a user.

Figure 5:
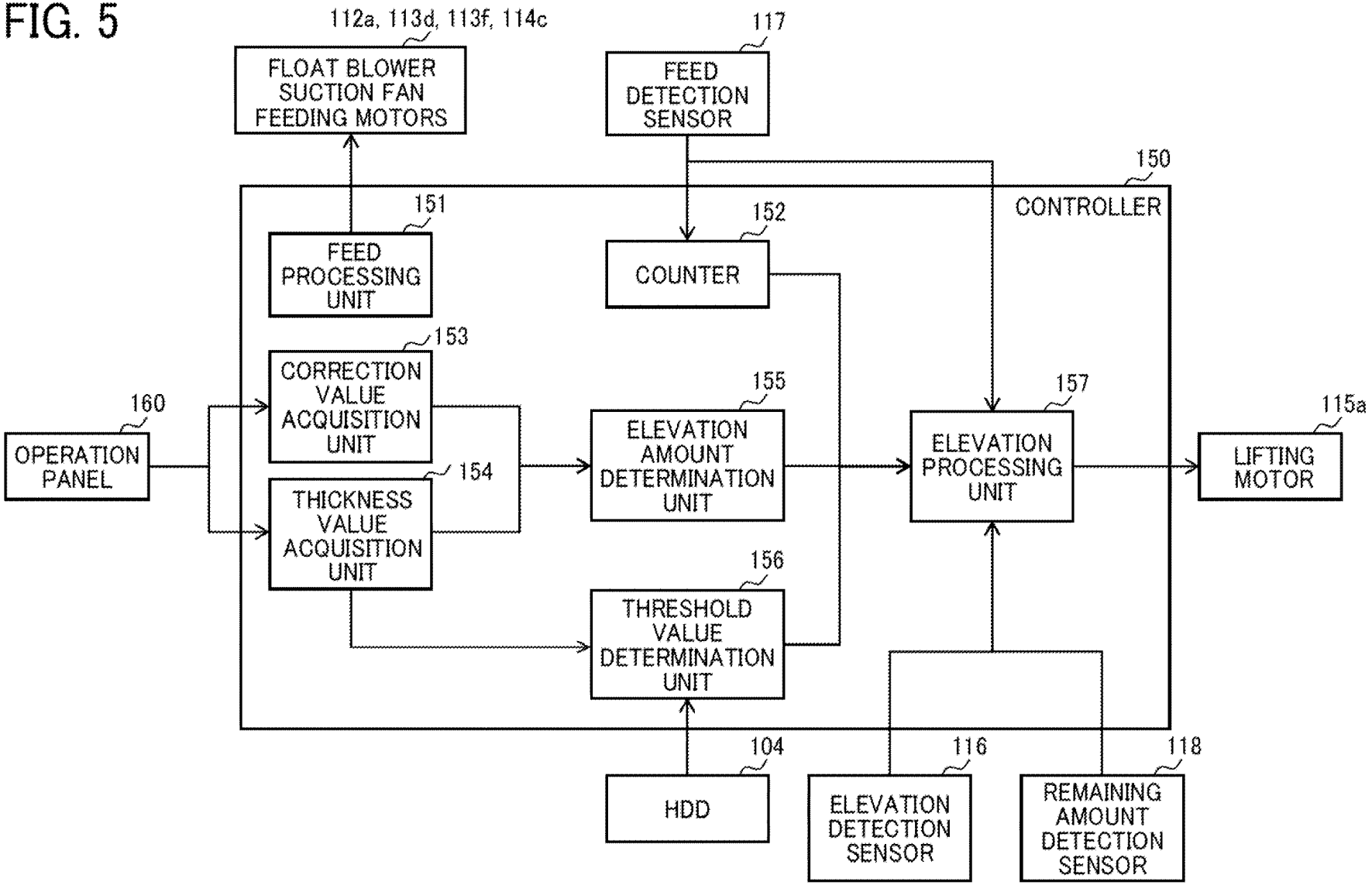
FIG. 5 is a functional block diagram of a controller according to an embodiment of the present disclosure.

FIG. 5 is a functional block diagram of the controller 150, according to the present embodiment. The controller 150 typically includes a feed processing unit 151, a counter 152, a correction value acquisition unit 153, a thickness value acquisition unit 154, an elevation amount determination unit 155, a threshold value determination unit 156, and an elevation processing unit 157. Each of the controller 150, the feed processing unit 151, the counter 152, the correction value acquisition unit 153, the thickness value acquisition unit 154, the elevation amount determination unit 155, the threshold value determination unit 156, and the elevation processing unit 157 as the functional blocks that constitutes the controller 150 is implemented by, for example, the CPU 101 that executes programs stored in the memory. The controller 150, the feed processing unit 151, the counter 152, the correction value acquisition unit 153, the thickness value acquisition unit 154, the elevation amount determination unit 155, the threshold value determination unit 156, and the elevation processing unit 157 as the functional blocks operate in conjunction with each other to feed multiple sheets M stacked on the sheet stacker 111 to the conveyance path R1 one by one, as illustrated in FIG. 5.

As illustrated in FIG. 5, the feed processing unit 151 drives the float blower 112*a*, the suction fan 113*f*, and the feeding motors 113*d* and 114*c* to feed the multiple sheets M stacked on the sheet stacker 111 to the conveyance path R1 in order one by one.

The counter 152 counts the number of sheets M fed by the feed processing unit 151. Specifically, the counter 152 increments the number of sheets fed N, stored in the HDD 104 each time when a feed signal is output from the feed detection sensor 117. The number of sheets fed N is reset when sheets M are replenished to the sheet stacker 111 or in step S809 of FIG. 8 and an initial value zero is assigned as the number of sheets fed N.

The correction value acquisition unit 153 acquires correction values $\alpha 1$ and $\alpha 2$ through the operation panel 160 input by a user of the image forming apparatus 100. The correction values $\alpha 1$ and $\alpha 2$ according to the present embodiment are numerical values larger than one ($\alpha 1>1$, $\alpha 2>1$). Further, the correction value $\alpha 2$ is larger than the correction value $\alpha 1$ ($\alpha 2>\alpha 1$).

The thickness value acquisition unit 154 acquires a sheet thickness t of sheets M stacked on the sheet stacker 111 through the operation panel 160 input by a user. As an example, a user may directly input the sheet thickness t through the operation panel 160. As another example, a user may input a basis weight of the sheet M through the operation panel 160. Then, the thickness value acquisition unit 154 may read the sheet thickness t corresponding to the input basis weight (for example, a sheet thickness tmin, a sheet thickness tavg., and a sheet thickness tmax in FIG. 7) from the memory. The sheet thickness tmax, the sheet thickness tmin, and the sheet thickness tavg. are a maximum value, a minimum value, and an average value, respectively, of the sheet thickness t corresponding to the input basis weight. The feeder 110 may include a thickness detection sensor that detects the sheet thickness t. The thickness value acquisition unit 154 may acquire the sheet thickness t detected by the thickness detection sensor.

The elevation amount determination unit 155 determines elevation amounts H1 and H2 of the sheet stacker 111 lifted by the elevation processing unit 157 based on the correction values $\alpha 1$ and $\alpha 2$ acquired by the correction value acquisition unit 153 and the sheet thickness t acquired by the thickness value acquisition unit 154. The elevation amount H1 as a first elevation amount is an elevation amount of the sheet stacker 111 when the remaining amount of sheets M detected by the remaining amount detection sensor 118 is equal to or greater than the threshold remaining amount of X %. The elevation amount H2 as a second elevation amount is an elevation amount of the sheet stacker 111 when the remaining sheet amount of sheets M detected by the remaining amount detection sensor 118 is smaller than the threshold remaining amount of X %. The elevation amount H2 is set to a value larger than the elevation amount H1.

Figure 6:
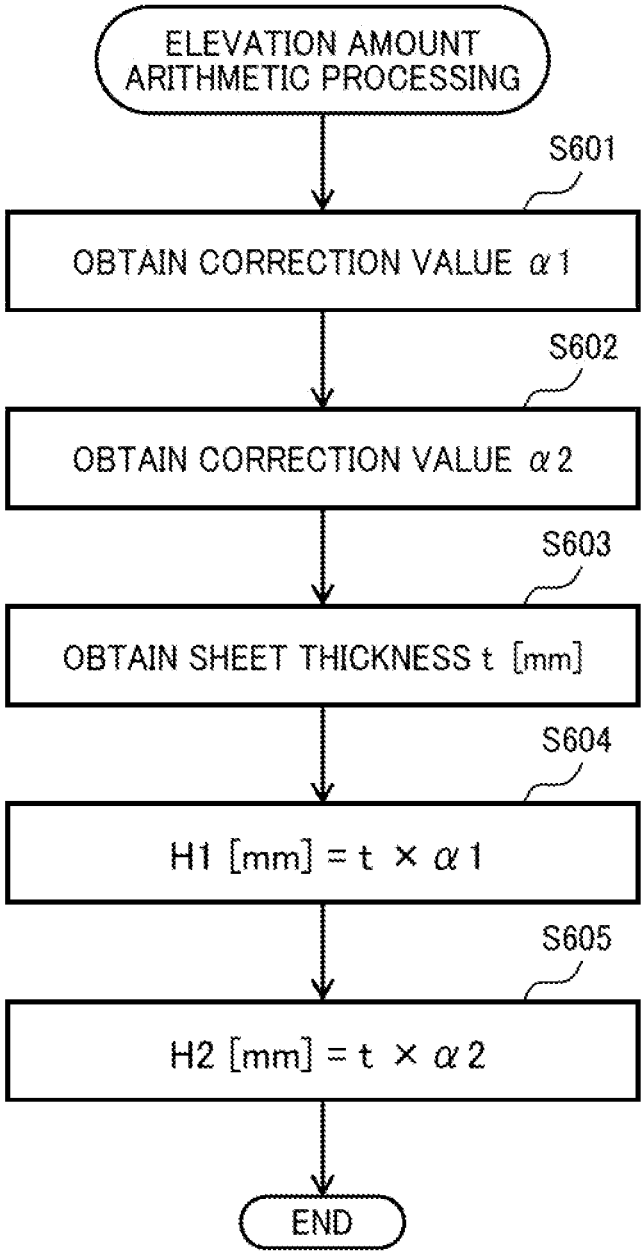
FIG. 6 is a flowchart of elevation amount calculation processing according to an embodiment of the present disclosure.

FIG. 6 is a flowchart illustrating how an elevation amount calculation processing is performed according to the present embodiment. The elevation amount determination unit 155 acquires the correction values $\alpha 1$ and $\alpha 2$ through the correction value acquisition unit 153 (S601, S602). In addition, the elevation amount determination unit 155 acquires the thickness t through the thickness value acquisition unit 154 (S603). Then, the elevation amount determination unit 155 multiplies the sheet thickness t by the correction value $\alpha 1$ to determine the elevation amount H1 (S604). Further, the elevation amount determination unit 155 multiplies the sheet thickness t by the correction value $\alpha 2$ to determine the elevation amount H2 (S605). Each of the correction values $\alpha 1$ and $\alpha 2$ is larger than one. Accordingly, each of the elevation amounts H1 and H2 is larger than the sheet thickness t.

However, the method of determining the elevation amounts H1 and H2 is not limited to the example of FIG. 6. As another example, the elevation amount determination unit 155 may add the correction amount $\alpha 1$ to the sheet thickness t to determine the elevation amount H1, and may add the correction value $\alpha 2$ to the sheet thickness t to determine the elevation amount H2. The correction values α1 and α2 in this case are positive values. As still another example, the elevation amount determination unit 155 may acquire the elevation amounts H1 and H2 from a user through the operation panel 160.

The threshold value determination unit 156 determines a threshold number of sheets Nth. The threshold number of sheets Nth is a value equivalent to the number of sheets fed N that indicates the number of sheets fed M when the processing of lifting the sheet stacker 111 is stopped. In other words, the threshold number of sheets Nth is a value to be compared with the number of sheets fed N. The threshold number of sheets Nth may be a fixed value. However, the threshold number of sheets Nth can be determined by, for example, the following method described below.

Figure 7:
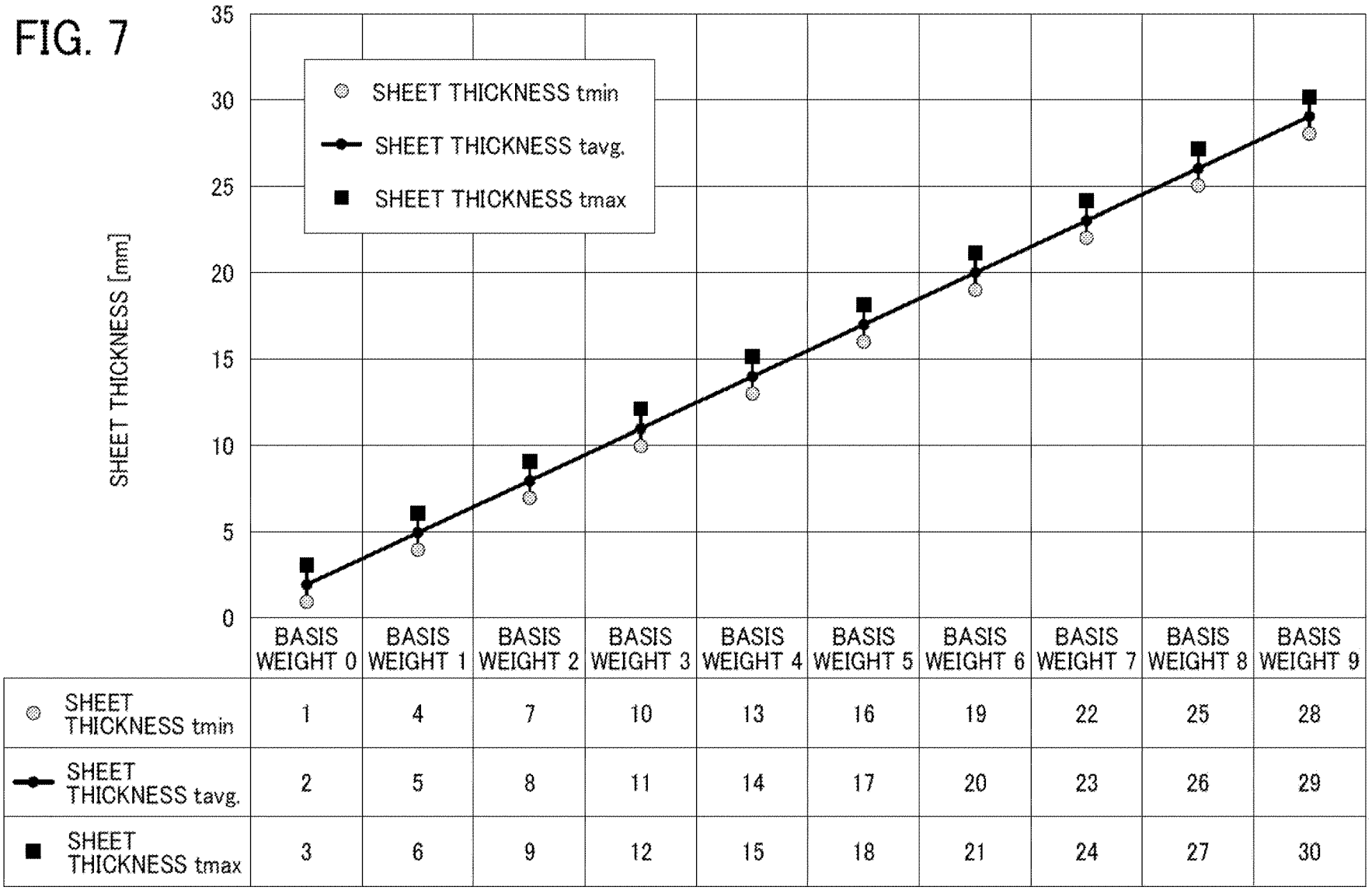
FIG. 7 is a graph illustrating a correspondence relation between basis weight and range of sheet thickness stored in a memory, according to an embodiment of the present disclosure.

FIG. 7 is a graph illustrating a correspondence relation between basis weight and range of sheet thickness stored in the memory. As illustrated in FIG. 7, the correspondence relations between multiple basis weights 0, 1, 2, 3, 4, 5, 6, 7, 8, and 9 and the ranges of sheet thicknesses are stored in the HDD 104 serving as memory. The basis weight refers to a weight per 1 $m^2$ of the sheet M. The range of the sheet thickness ranges from a maximum value, i.e., the sheet thickness tmax to a minimum value, i.e., the sheet thickness tmin of a sheet M having a corresponding basis weight. An average value, i.e., the sheet thickness tavg. of sheets M corresponding to each corresponding one of the basis weights may be stored in the HDD 104. Further, an actual sheet thickness of a sheet M fed from the feeder 110 is set as a set sheet thickness t0 as a set sheet thickness value. For example, the set sheet thickness t0 may be set by a user through the operation panel 160 or may be set to a sheet thickness value corresponding to the basis weight stored in the HDD 104.

For example, the threshold value determination unit 156 reads the sheet thickness tmin, which corresponds to a basis weight input through the operation panel 160, from the HDD 104. Then, the threshold value determination unit 156 determines the threshold number of sheets Nth based on the following formula 1. Note that a in the formula 1 described below is one of the correction values α1 and α2 acquired by the correction value acquisition unit 153.

$$\text{Threshold number of sheets } Nth = h \times 1000/(\alpha \times t0 - t\min) \qquad \text{Formula 1}$$

As another example, the threshold value determination unit 156 may determine the threshold number of sheets Nth based on the following formula 2. Note that a in the formula 2 described below is one of the correction values α1 and α2 acquired by the correction value acquisition unit 153. In this case, the correspondence relation illustrated in FIG. 7 can be omitted.

$$\text{Threshold number of sheets } Nth = h \times 1000/(\alpha \times t0 - t) \qquad \text{Formula 2}$$

The elevation processing unit 157 causes the lifting mechanism 115 to lift the sheet stacker 111 based on signals output from the elevation detection sensor 116, the feed detection sensor 117, and the remaining amount detection sensor 118, the number of sheets fed N counted by the counter 152, the elevation amounts H1 and H2 determined by the elevation amount determination unit 155, and the threshold number of sheets Nth determined by the threshold value determination unit 156. In addition, the elevation processing unit 157 causes the lifting mechanism 115 to lower the sheet stacker 111 at a timing when sheets M are replenished to the sheet stacker 111.

Figure 8:
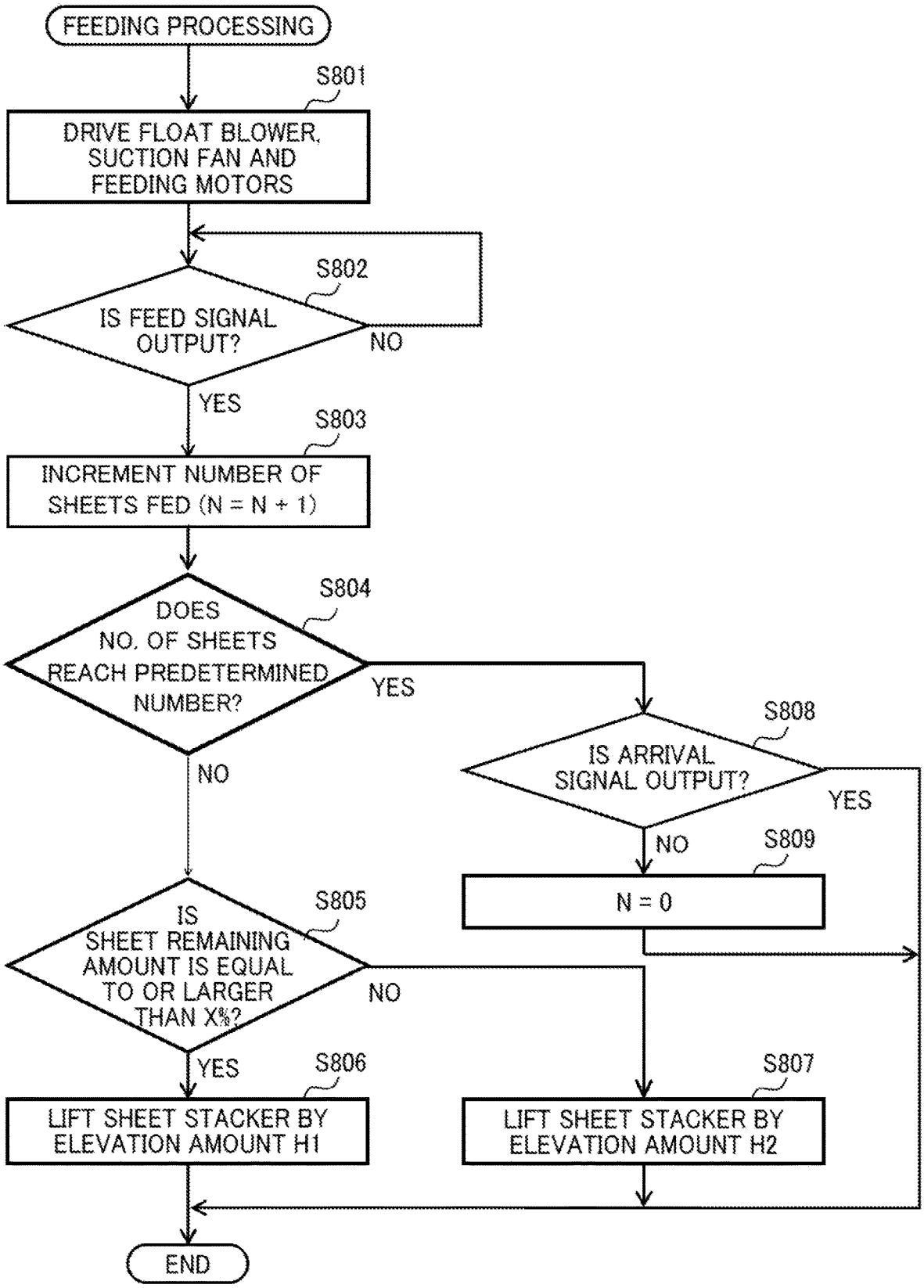
FIG. 8 is a flowchart illustrating feeding processing according to an embodiment of the present disclosure.

FIG. 8 is a flowchart of feeding processing according to the present embodiment. The controller 150 executes the feeding processing at a timing when an image forming instruction is input to the image forming apparatus 100. The controller 150 repeatedly executes the feeding processing when images are formed on multiple sheets M. Note that the feeding processing is executed by the feeding processing unit 151, the counter 152, and the elevation processing unit 157. On the other hand, the processing of the correction value acquisition unit 153, the thickness value acquisition unit 154, the elevation amount determination unit 155, and the threshold value determination unit 156 is executed before the feeding processing starts.

First, the feeding processing unit 151 drives the float blower 112*a*, the suction fan 113*f*, and the feeding motors 113*d* and 114*c* (S801). Thus, as illustrated in FIGS. 3A, 3B, and 3C, one sheet M is fed to the feed path R0. Then, the execution of the feeding processing after step S803 is put on standby until a feeding signal is output from the feed detection sensor 117 (NO in S802).

When the feed signal is output from the feed detection sensor 117 (YES in S802), the counter 152 increments the number of sheets fed N stored in the HDD 104 (N=N+1) (S803). Further, in response to the output of the feed signal from the feed detection sensor 117 (YES in S802), the elevation processing unit 157 executes the processing of steps S804, S805, S806, S807, S808, and S809. Further, in parallel with the processing in steps S803, S804, S805, S806, S807, S808, and S809, the conveyor 120 and the image forming device 130 convey the sheet M fed from the feeder 110 in the conveyance path R1 and form an image on the sheet M.

The elevation processing unit 157 compares the number of sheets fed N counted by the counter 152 with the threshold number of sheets Nth determined by the threshold value determination unit 156 (S804). When the number of sheets fed N is smaller than the threshold number of sheets Nth (NO in S804), the elevation processing unit 157 determines whether a remaining amount signal is output from the remaining amount detection sensor 118, in other words, whether the sheet remaining amount is equal to or greater than the threshold remaining amount of X % (S805).

Then, when the remaining amount signal is output from the remaining amount detection sensor 118, in other words, the remaining amount of sheets M is equal to or greater than the threshold remaining amount of X % (YES in S805), the elevation processing unit 157 drives the lifting mechanism 115 so that the sheet stacker 111 is lifted by the elevation amount H1 determined by the elevation amount determination unit 155 (S806). Further, when the output of the remaining amount signal from the remaining amount detection sensor 118 is stopped, in other words, the remaining amount of sheets M is smaller than the threshold remaining amount of X % (NO in S805), the elevation processing unit 157 drives the lifting mechanism 115 so that the sheet stacker 111 is lifted by the elevation amount H2 determined by the elevation amount determination unit 155 (S807).

On the other hand, when the number of sheets fed N reaches the threshold number of sheets Nth (YES in S804), the elevation processing unit 157 determines whether an arrival signal is output from the elevation detection sensor 116, in other words, whether sheets M are present at the detection position (S808). When the arrival signal is output from the elevation detection sensor 116, in other words, the sheets M are present at the detection position (YES in S808), the elevation processing unit 157 ends the feeding processing without executing the processing of steps S805, S806, S807, S808, and S809. In addition, when the output of the arrival signal from the elevation detection sensor 116 is stopped, in other words, the sheets M are not present at the detection position (NO in S808), the elevation processing unit 157 resets the number of sheets fed N stored in the HDD 104 and the initial value zero is assigned as the number of sheets fed N without executing the processing of steps S805, S806, and S807 (S809).

In other words, when the number of sheets fed N counted by the counter 152 is smaller than the threshold number of sheets Nth (NO in S804) while the feeding processing is repeatedly performed, the elevation processing unit 157 lifts the sheet stacker 111 each time the feed signal is output from the feed detection sensor 117 (S805, S806, S807). When the number of sheets fed N counted by the counter 152 reaches the threshold number of sheets Nth while the feeding processing is repeatedly performed (YES in S804), the elevation processing unit 157 stops the lifting of the sheet stacker 111. Further, the elevation processing unit 157 restarts the lifting of the sheet stacker 111 from the next feeding processing in which the number of sheets fed N is reset (S809).

According to the above-described embodiments, for example, the following operational effects can be achieved.

The above-described embodiments allow the sheet stacker 111 to be lifted each time one sheet M is fed. Accordingly, an uppermost sheet M stacked on the sheet stacker 111 can be positioned in a path in which air is blown from the air blower 112. Accordingly, non-feeding of the sheet M in the feeding processing can be prevented. In addition, setting the elevation amounts H1 and H2 to values greater than the sheet thickness t can effectively prevent the sheet M from not being fed in the feeding processing.

However, when the lifting of the sheet stacker 111 is repeated, an error between the total of the sheet thicknesses t of the multiple fed sheets M and the total of the elevation amounts of the sheet stacker 111 is accumulated. Accordingly, as in one of the above-described embodiments, the lifting of the sheet stacker 111 is temporarily stopped when the threshold number of sheets Nth is fed. Thus, the accumulated error can be reset. Accordingly, double feeding caused by multiple sheets M floating together can be prevented.

Non-feeding or double feeding of sheets M is likely to occur when the stacking height of the sheets M on the sheet stacker 111 is low. For this reason, as described in the above embodiments, the elevation amount H2 when the remaining amount of sheets M is small, is set to a value greater than the elevation amount H1 when the remaining amount of sheets M is large. Thus, the sheets M can be reliably fed even when the stacking height of the sheets M on the sheet stacker 111 is low. However, the elevation amount of the sheet stacker 111 may be set to a constant value regardless of the remaining amount of sheets M on the sheet stacker 111. In other words, steps S602 and S605 in FIG. 6 and steps S805 and S807 in FIG. 8 can be omitted.

Furthermore, as described in the above-described embodiments, the threshold number of sheets Nth using formula 1 or formula 2 is set and the lifting of the sheet stacker 111 is stopped when the number of sheets fed N reaches the threshold number of sheet Nth. Accordingly, double feeding of sheets M caused by the sheet stacker 111 and the endless annular belt 113*c* moving too close to each other can be prevented.

Each of the functions that have been described in the above-described embodiments can be implemented by one processing circuit or multiple processing circuits. In the embodiments of the present disclosure, the processing circuit includes a processor programmed to execute each of the functions by software such as a processor implemented by an electronic circuit, and a device such as an application specific integrated circuit (ASIC), a digital signal processor (DSP), a field programmable gate array (FPGA), or a conventional circuit module designed to execute each function described above.

Note that the present disclosure is not limited to the above-described embodiments, and various modifications can be made without departing from the technical gist of the present disclosure, and all technical matters included in the technical idea described in the claims are the object of the present disclosure. It is therefore to be understood that the disclosure of the present specification may be practiced otherwise by those skilled in the art than as specifically described herein. Such embodiments and modifications thereof are included in the scope and gist according to the embodiments of the present disclosure and are included in the embodiments described in claims and the equivalent scope thereof.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure. Any one of the above-described operations may be performed in various other ways, for example, in an order different from the one described above.

The present disclosure can be implemented in any convenient form, for example using dedicated hardware, or a mixture of dedicated hardware and software. The present disclosure may be implemented as computer software implemented by one or more networked processing apparatuses. The processing apparatuses include any suitably programmed apparatuses such as a general purpose computer, a personal digital assistant, a Wireless Application Protocol (WAP) or third-generation (3G)-compliant mobile telephone, and so on. Since the present disclosure can be implemented as software, each and every aspect of the present disclosure thus encompasses computer software implementable on a programmable device. The computer software can be provided to the programmable device using any conventional carrier medium (carrier means). The carrier medium includes a transient carrier medium such as an electrical, optical, microwave, acoustic or radio frequency signal carrying the computer code. An example of such a transient medium is a Transmission Control Protocol/Internet Protocol (TCP/IP) signal carrying computer code over an IP network, such as the Internet. The carrier medium may also include a storage medium for storing processor readable code such as a floppy disk, a hard disk, a compact disc read-only memory (CD-ROM), a magnetic tape device, or a solid state storage medium.

The invention claimed is:

1. A sheet feeding apparatus comprising:

a sheet stacker on which a plurality of sheets are stacked;

an air blower configured to blow air from a lateral side of the plurality of sheets stacked on the sheet stacker to the plurality of sheets to float an uppermost sheet of the plurality of sheets;

a suction feeder disposed above the sheet stacker and configured to suck the uppermost sheet floated by the air blower and feed the sheet in a feed direction;

a lifting mechanism configured to lift the sheet stacker;

an elevation detection sensor configured to detect that the plurality of sheets stacked on the sheet stacker has reached a detection position located above the sheet stacker and below the suction feeder;

a feed detection sensor configured to detect the sheet fed by the suction feeder; and processing circuitry configured to control operations of the air blower, the suction feeder, and the lifting mechanism based on detection results of the elevation detection sensor and the feed detection sensor, wherein the processing circuitry is configured to:

drive the lifting mechanism such that the sheet stacker is lifted by an elevation amount determined based on a sheet thickness of the sheets stacked on the sheet stacker, each time a sheet is detected by the feed detection sensor when a number of sheets detected by the feed detection sensor is smaller than a threshold number of sheets; and stop lifting of the sheet stacker until a sheet is not detected by the elevation detection sensor when the number of sheets reaches the threshold number of sheets, while repeatedly performing processing to feed the uppermost sheet floated by the air blower to the suction feeder and count the number of sheets detected by the feed detection sensor.

2. The sheet feeding apparatus according to claim 1, further comprising a remaining amount detection sensor configured to detect a remaining amount of sheets stacked on the sheet stacker;

wherein the processing circuitry is configured to:

drive the lifting mechanism such that the sheet stacker is lifted by a first elevation amount when the remaining amount of sheets detected by the remaining amount detection sensor is equal to or greater than a threshold remaining amount; and drive the lifting mechanism such that the sheet stacker is lifted by a second elevation amount greater than the first elevation amount when the remaining amount of sheets detected by the remaining amount detection sensor is smaller than the threshold remaining amount.

3. The sheet feeding apparatus according to claim 1, wherein the feed detection sensor is disposed to face a feed path of a sheet at a position downstream from the suction feeder in the feed direction, and wherein the feed detection sensor is configured to detect a sheet passing through the feed path.

4. The sheet feeding apparatus according to claim 1, wherein the processing circuitry multiplies the sheet thickness by a correction value greater than one, to determine the elevation amount.

5. The sheet feeding apparatus according to claim 4, further comprising a thickness detection sensor configured to detect the sheet thickness, and wherein the processing circuitry is configured to determine the elevation amount based on the sheet thickness detected by the thickness detection sensor.

6. The sheet feeding apparatus according to claim 4, further comprising an operation panel configured to receive an input operation of a user, wherein the processing circuitry is configured to determine the elevation amount based on the sheet thickness input through the operation panel.

7. The sheet feeding apparatus according to claim 6, wherein the processing circuitry is configured to determine the elevation amount based on the correction value input through the operation panel.

8. The sheet feeding apparatus according to claim 4, further comprising a memory configured to store a basis weight of a sheet and a range of a sheet thickness in association with each other, wherein the controller is configured to determine the threshold number of sheets based on a formula of $h \times 1000/(\alpha \times t0 - tmin)$, where h is a height from the detection position to the suction feeder, $\alpha$ is the correction value, t0 is a set sheet thickness, and tmin is a minimum sheet thickness corresponding to a basis weight of the sheets stacked on the sheet stacker.

9. The sheet feeding apparatus according to claim 4, wherein the processing circuitry is configured to determine the threshold number of sheets based on a formula of $h \times 1000/(\alpha \times t0 - t)$, where h is a height from the detection position to the suction feeder, $\alpha$ is the correction value, t0 is a set sheet thickness, and t is the sheet thickness of the sheets stacked on the sheet stacker.

10. An image forming apparatus comprising:

the sheet feeding apparatus according to claim 1; and an image forming device configured to form an image on a sheet fed by the sheet feeding apparatus.

* * * * *